United States Patent [19]

Silverman et al.

[11] 4,453,929

[45] Jun. 12, 1984

[54] ACTIVATED CHARCOAL PACKAGE AND PROCESS

[76] Inventors: Louis J. Silverman, 1725 Novato Blvd., #15, Novato, Calif. 94947; Amy Hewitt, 309 Walnut St., Petaluma, Calif. 94952

[21] Appl. No.: 373,337

[22] Filed: Apr. 30, 1982

[51] Int. Cl.[3] ..... A61J 7/00

[52] U.S. Cl. ..... 604/56; 128/1 R

[58] Field of Search ..... 604/54, 56, 82, 84, 604/87, 88, 92, 257, 262, 408, 414, 416, 415, 411; 424/125

[56] References Cited

U.S. PATENT DOCUMENTS 2,838,046 6/1958 Butler ..... 604/415
3,587,576 6/1971 Reikes et al. ..... 128/656
3,991,912 11/1976 Soto ..... 604/262
4,122,169 10/1978 Geils ..... 424/125

*Primary Examiner*—C. Fred Rosenbaum
*Assistant Examiner*—Sherri E. Vinyard
*Attorney, Agent, or Firm*—Willis E. Higgins

[57] ABSTRACT

A package for administration of activated charcoal (28) to a patient's stomach has a closed container (10) in which there is a predetermined quantity of dry, finely divided activated charcoal (28). There is a means (20, 16) for introducing a pharmaceutically acceptable liquid (30) to the activated charcoal (28) for mixture therewith. A means (18) is provided for attaching one end (52) of a tube (38) to the container (10). The tube (38) has an end (40) remote from the one end (52) for administration of the activated charcoal-liquid mixture (34) to the patient.

3 Claims, 2 Drawing Figures

ACTIVATED CHARCOAL PACKAGE AND PROCESS

BACKGROUND OF THE INVENTION

1. Field of the Invention

This invention relates to a package and process for the convenient administration of activated charcoal to a patient, especially under emergency conditions. More particularly, it relates to such a package and process which will allow dry, finely divided activated charcoal to be mixed with a liquid at the time of use while preserving dose integrity and avoiding the soiling of surroundings with the dry activated charcoal or the mixture.

2. Description of the Prior Art

One of the standard techniques for the emergency treatment of drug overdose or poisoning cases in which the drug or poison has been swallowed is the administration of finely divided activated charcoal which has been mixed with a liquid, either orally or through a stomach tube. The activated charcoal adsorbs the drug or poison which remains in the patient's gastro-intestinal tract to inactivate the drug or poison rapidly.

One drawback in this remedy as presently practiced is that the activated charcoal has a short life when it is mixed with water or other pharmaceutically acceptable liquid. Therefore, the conventional practice is to mix the finely divided activated charcoal with the liquid at the time of use. Mixing the activated charcoal with water or other liquid in an open container is a messy procedure, because a portion of the dry powder tends to become airborne when the water is added to it rather than being wetted. Also, the mixing is done under emergency conditions, when it is desired to introduce the mixture to the patient's stomach as soon as possible to avoid further adsorption of a drug or poison into the patient's blood stream. The activated charcoal-liquid mixture is not appealing to a conscious patient, especially a child. The usual result from these factors is to soil both the clothes of emergency room personnel as well as emergency room facilities during administration of this remedy. The perceived unpleasantness of the black liquid mixture and the airborne loss of a portion of it also mean that significantly less than the actual intended dose will often arrive in the patient's stomach. These factors further mean that the remedy is not easily administered in the field by paramedics when the time to transport a victim to an emergency room might make a critical difference in survival.

There are a wide variety of packages for administering various liquids to patients, either with or without mixing powdered materials with the liquids prior to administration. Examples of such packages are disclosed in U.S. Pat. Nos. 2,917,047; 3,587,576; 3,645,262; 3,726,276; 3,773,243; 3,818,910; 3,865,107; French Pat. No. 11,495; and Norwegian Pat. No. 33,657. However, none of these packages or devices are particularly adapted for use with activated charcoal. A need, therefore, still remains for a package and process for administering activated charcoal to patients which will overcome the above problems.

SUMMARY OF THE INVENTION

Accordingly, it is an object of this invention to provide a package and process for storing activated charcoal in dry form at premeasured dose quantities and mixing the dry activated charcoal with a liquid in a convenient manner.

It is another object of the invention to provide such a package and process in which the activated charcoal is not introduced into the surrounding air during the mixing process.

It is a further object of the invention to provide such a package and process in which dose integrity of the activated charcoal is maintained during the administration process.

It is still another object of the invention to provide a package, assembly and process in which activated charcoal is stored in dry, dose form until use is required, mixed with a liquid at the time of use, and administered to the stomach of a patient, all without introducing the dry activated charcoal or liquid mixture to the surroundings.

The attainment of these and related objects may be achieved through use of the novel activated charcoal package and process herein disclosed. The package of this invention includes a closed container. A predetermined quantity of dry, finely divided activated charcoal is contained within the container. The container has a means for introducing a pharmaceutically acceptable liquid to the activated charcoal container for mixture with the activated charcoal. There is a means for attaching one end of the tube to the container, with the tube having an end remote from the one end for administration of the activated charcoal to the patient. The package is desirably formed of a flexible material, such as plastic, so that the activated charcoal and liquid can be mixed inside the package by flexing the package. The tube attached to the package in its use is also preferably a stomach tube, so that the activated charcoal-liquid mixture can be administered to an unconscious patient.

In use of the package of this invention in the process of the invention, a sufficient quantity of a pharmaceutically acceptable liquid to produce a flowable mixture of the predetermined quantity of the activated charcoal and the liquid is injected into the sealed flexible container. The container is then flexed to mix the activated charcoal and liquid, thus giving the flowable mixture. One end of the tube is connected to the interior of the flexible container, and the flowable mixture is allowed to flow through the tube to the patient.

Through use of the package and process of this invention, activated charcoal and a liquid may be conveniently mixed at the time of use. The resulting mixture may be conveniently administered to a patient and the integrity of the dose maintained. Both the mixing and the administration may be carried out without spilling the dry activated charcoal or the mixture into the surroundings.

The attainment of the foregoing and related objects, advantages and features of the invention should be more readily apparent to those skilled in the art after review of the following more detailed description of the invention, taken together with the drawings, in which:

DETAILED DESCRIPTION OF THE INVENTION

Figure 1:
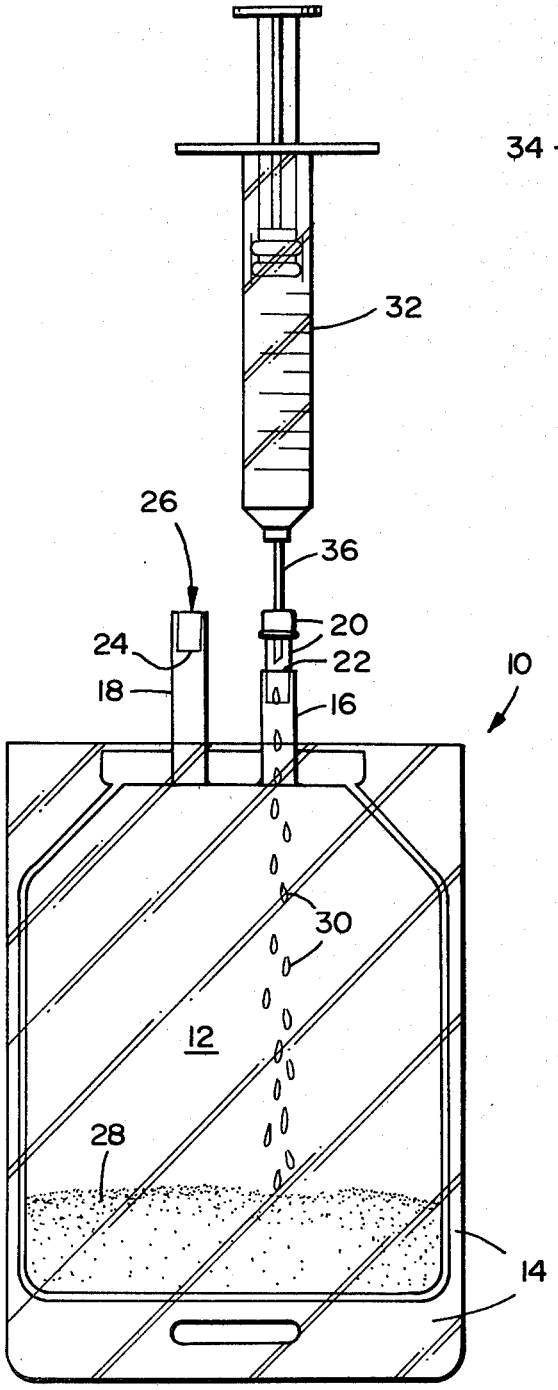
FIG. 1 is a side view of a package in accordance with the invention during its use.

Turning now to the drawings, more particularly to FIG. 1, there is shown a package 10 in accordance with the invention. The package 10 is formed from sheets 12 of a flexible plastic, such as polyethylene, vinyl, polyethylene terephthalate, or the like. The plastic sheets 12 are heat-sealed or otherwise bonded around their edges 14 to provide a hermetically sealed container in a conventional manner as employed in the fabrication of flexible intravenous solution containers. The package has first and second tubes 16 and 18 extending from the enclosure formed by the plastic sheets 12. The first tube 16 has an injection fitting 20 inserted in its end 22. The second tube 18 has a rupturable plastic diaphragm 24 sealing its end 26. Contained within the enclosure formed by the sheets 12 is a predetermined quantity of dry, finely divided activated charcoal 28 of the type conventionally administered in drug overdose or poison cases. Typically, the quantity of activated charcoal 28 in the package 10 is from about 20 to about 50 grams, depending on whether the package 10 is for use with a small child or a large adult. The most common dose is about 30 grams. The package is stored in its sealed form, containing the dry, activated charcoal until use is required.

In use of the package 10, a sufficient quantity of water, aqueous citrate of magnesia solution, or other pharmaceutically acceptable liquid 30 is injected from hypodermic syringe 32 into the package 10 through injection fitting 20 in order to produce a flowable mixture with the dry activated charcoal 28. Assuming that the package 10 contains 30 grams of the activated charcoal 28, a quantity of from about 50 ml to about 100 ml of the liquid 30 is sufficient for this purpose. A large syringe 32, such as a conventional gastric syringe is best for this purpose. After the liquid 30 has been injected, the package 10 is flexed, typically for 30 seconds to one minute, to produce a flowable mixture 34 (FIG. 2) of the activated charcoal 28 and the liquid 30. Since tube 18 is sealed by partition 24 and the injection fitting 20 in tube 16 has only been penetrated by hypodermic needle 36, none of the dry activated charcoal 28 or the mixture 34 is introduced to the surroundings of package 10 during the injection of the liquid 30 and the flexing to produce the activated charcoal-liquid mixture 34.

Figure 2:
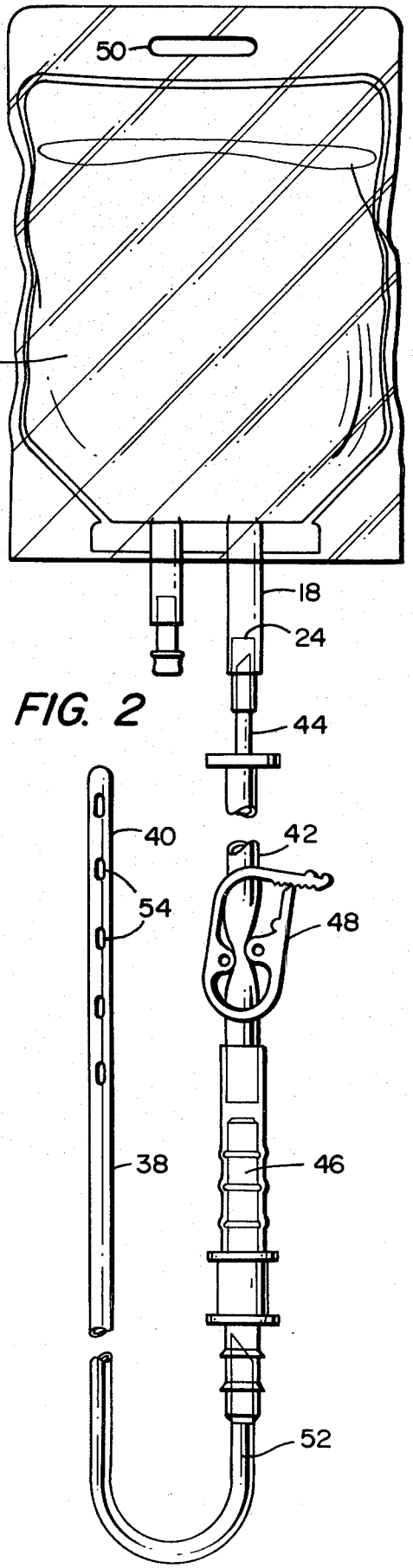
FIG. 2 is another front view of the package at a different point in the process of its use.

The package 10, now containing the mixture 34, is typically assembled with a stomach tube 38, as shown in FIG. 2, for administration of the mixture 34 to the patient. In the usual mode of administration, the end 40 of the stomach tube 38 is introduced into the stomach of the patient before connecting the tube 38 to the package 10, a saline solution is used to irrigate the stomach and is withdrawn through the stomach tube 38 by means of vacuum aspiration. Apertures 54 in end 40 of the stomach tube 38 are of sufficient size to allow undissolved drug tablet portions to enter the stomach tube 38 during the aspiration process. A short length of tubing 42, attached to sharp edge fitting 44 is connected to a fitting 46. The tubing 42 has a clamp 48 which blocks off its internal passageway until the clamp 48 is released. Package 10 containing the activated charcoal-liquid mixture 34 is inverted and hung from a suitable support in a conventional manner by aperture 50, above the patient. The tubing 42 is then connected to the package 10 by means of the sharp edged fixture 44, which ruptures the partition 24 in tube 18 on insertion. Fixture 46 is then connected to end 52 of the stomach tube 38. When clamp 48 is released, the activated charcoal-liquid mixture 34 flows through the tube 42 and stomach tube 38 to the stomach of the patient. After the mixture 34 has been drained into the stomach of the patient, end 52 of the stomach tube may be disconnected from the fixture 46 and the mixture 34 is allowed to pass through the bowels of the patient to adsorb the toxic material in the digestive tract.

It should now be apparent to those skilled in the art that an activated charcoal package and process capable of achieving the stated objects of the invention has been provided. The activated charcoal is provided in the package in dry form, conveniently mixed with a suitable liquid at the time of use, and administered to a patient, all without allowing either the dry activated charcoal or the activated charcoal-liquid mixture to enter the surroundings. Additionally, the entire dose provided in the package may be administered to a patient without loss. The package and process of this invention is especially adapted for use under emergency conditions in an emergency room. However, the construction of the package also allows convenient and accurate administration in the field as well.

It should further be apparent to those skilled in the art that various changes in form and details of the invention as shown and described may be made. For example, if desired, the liquid to be mixed with the dry activated charcoal may be provided in a separate compartment of the package, which is ruptured at the time of use for mixing the liquid and the activated charcoal. It is intended that such changes be included within the spirit and scope of the claims appended hereto.

What is claimed is:

1. A method for treating humans to remove undesirable materials from the gastrointestinal tract that are adsorbable by activated charcoal, which comprises providing a sealed, flexible container containing a predetermined quantity of dry, finely divided activated charcoal, introducing to the sealed, flexible container with a hypodermic needle through an injection fitting for the hypodermic needle, which injection fitting is free of leakage after removal of the hypodermic needle, a sufficient quantity of pharmaceutically acceptable liquid to produce a flowable suspension of the activated charcoal in the liquid, flexing the flexible container to produce the flowable suspension, connecting one end of a tube to the interior of the flexible container, and allowing the flowable suspension to flow through the tube and into the patient's stomach.

2. The process of claim 1 in which a second end of the tube is inserted in the stomach of the patient.

3. The process of claim 2 in which the pharmaceutically acceptable liquid is water or citrate of magnesia.

* * * * *